US008845406B2

(12) United States Patent
McIver

(10) Patent No.: US 8,845,406 B2
(45) Date of Patent: Sep. 30, 2014

(54) VENT SEALING DEVICE AND SYSTEM

(76) Inventor: Andrew McIver, Altamonte Springs, FL (US)

( * ) Notice: Subject to any disclaimer, the term of this patent is extended or adjusted under 35 U.S.C. 154(b) by 613 days.

(21) Appl. No.: 13/098,702

(22) Filed: May 2, 2011

(65) Prior Publication Data

US 2011/0275307 A1 Nov. 10, 2011

Related U.S. Application Data

(60) Provisional application No. 61/332,550, filed on May 7, 2010.

(51) Int. Cl.
*F24F 13/20* (2006.01)
*F24F 7/02* (2006.01)

(52) U.S. Cl.
CPC ..... *F24F 7/02* (2013.01); *F24F 2221/52* (2013.01)
USPC ..... 454/367; 454/4; 52/219

(58) Field of Classification Search
USPC ..... 454/3, 4, 367; 52/219
See application file for complete search history.

(56) References Cited

U.S. PATENT DOCUMENTS

| | | | | | |
|---|---|---|---|---|---|
| 558,025 | A * | 4/1896 | Barry, Jr. | 285/44 |
| 1,317,574 | A * | 9/1919 | Grosvold | 285/44 |
| 3,977,137 | A * | 8/1976 | Patry | 52/60 |
| 4,115,961 | A * | 9/1978 | Bishop | 52/58 |
| 4,206,692 | A | 6/1980 | Johnston | |
| 4,484,424 | A | 11/1984 | Logsdon | |
| 5,245,804 | A * | 9/1993 | Schiedegger et al. | 52/199 |
| 5,347,776 | A | 9/1994 | Skoff | |
| 5,390,451 | A * | 2/1995 | Kopp et al. | 52/58 |
| 5,431,815 | A * | 7/1995 | Te-Shin | 210/459 |
| 5,694,724 | A * | 12/1997 | Santiago | 52/219 |
| 5,724,777 | A * | 3/1998 | Hubbard | 52/198 |
| 5,778,611 | A * | 7/1998 | Michel | 52/198 |
| 5,979,505 | A * | 11/1999 | Drechsel | 138/32 |
| 6,244,006 | B1 * | 6/2001 | Shue et al. | 52/302.1 |
| 6,279,272 | B1 * | 8/2001 | Nill, Jr. | 52/58 |
| 7,775,005 | B2 * | 8/2010 | Johnston et al. | 52/219 |
| 8,479,455 | B2 * | 7/2013 | Schaefer et al. | 52/58 |
| 8,490,351 | B1 * | 7/2013 | Scott | 52/219 |
| 8,574,045 | B2 * | 11/2013 | Warner | 454/3 |
| 2003/0024185 | A1 * | 2/2003 | Menzies | 52/219 |
| 2006/0057950 | A1 * | 3/2006 | Heise | 454/4 |
| 2006/0211356 | A1 * | 9/2006 | Grassman | 454/4 |
| 2007/0101664 | A1 * | 5/2007 | Hoy et al. | 52/198 |
| 2008/0096480 | A1 * | 4/2008 | Parry | 454/4 |
| 2008/0098673 | A1 * | 5/2008 | Johnston et al. | 52/198 |
| 2011/0302876 | A1 * | 12/2011 | Giffin | 52/741.4 |

* cited by examiner

*Primary Examiner* — Steven B McAllister
*Assistant Examiner* — Jonathan Cotov
(74) *Attorney, Agent, or Firm* — Jason T. Daniel, Esq.; Daniel Law Offices, P.A.

(57) ABSTRACT

A vent sealing device includes an elongated tubular member having an inner tube with a collar at the upper end of the inner tube, and a cap having an upper interior surface configured to receive the inner tube assembly, a lower interior surface configured to receive said outer tube, and a screen configured to remove debris positioned along the top of the assembly. A vent sealing system includes a roof attachment unit that includes an elongated base structure having an opening that includes a flexible sleeve protruding outward therefrom.

16 Claims, 7 Drawing Sheets

VENT SEALING DEVICE AND SYSTEM

CROSS-REFERENCE TO RELATED APPLICATIONS

This application claims the benefit of U.S. Application Ser. No. 61/332,550 filed on 7 May, 2010, which is fully incorporated herein by reference.

BACKGROUND

Roof structures typically have one or more openings to allow vents and other objects to extend through. For example, plumbing vents are typically required at all drainage points in a building so that air can displace water draining into the sewer system. During new construction of a building, a hole is cut into the roof structure and a vent pipe is then routed through the hole and connected to the building plumbing. In order to maintain a water-tight seal between the vent and the roof, flashing material (often made from lead) is used to surround the vent and mate with the roof. Unfortunately, squirrels and other rodents are often attracted to the lead flashing and tend to damage it with their claws and teeth. Over time, the damaged flashing can leak or otherwise provide a sub-nominal seal between the vent and roof. Moreover, as the top of the vent pipe is designed to be open to the air, it is common for small animals, rodents and insects to freely enter the vent and gain access to the building plumbing and/or the building itself.

Accordingly, a need exists for a vent sealing device and system that is able to cure the above described deficiencies and which can be easily installed on a new or existing roof structure.

SUMMARY OF THE INVENTION

The present invention is directed to a vent sealing device and system for protecting roofing ventilation shafts.

One embodiment of the present invention can include a vent sealing device that includes an elongated tubular member having an inner tube with a collar at the upper end of the inner tube, and a cap having an upper interior surface configured to receive the inner tube assembly, a lower interior surface configured to receive said outer tube, and a screen configured to remove debris positioned along the top of the assembly.

Another embodiment of the present invention can include a roof attachment unit that includes an elongated base structure having an opening that includes a flexible sleeve protruding outward therefrom.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Figure 1:
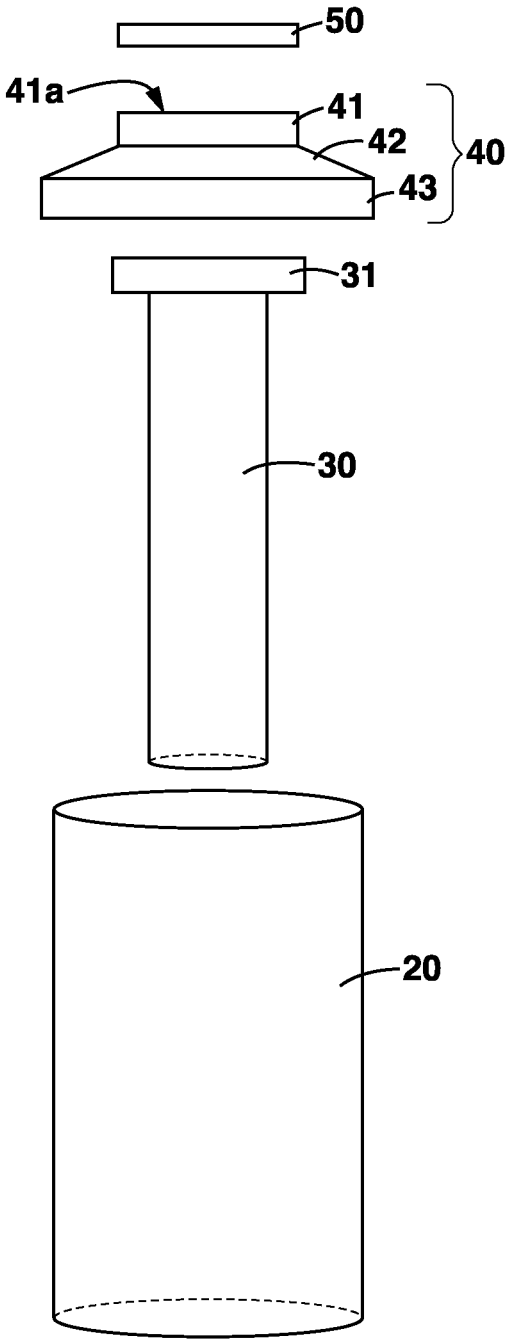
FIG. 1 is an exploded view of a vent sealing device that is useful for understanding the embodiments disclosed herein.
Figure 2:
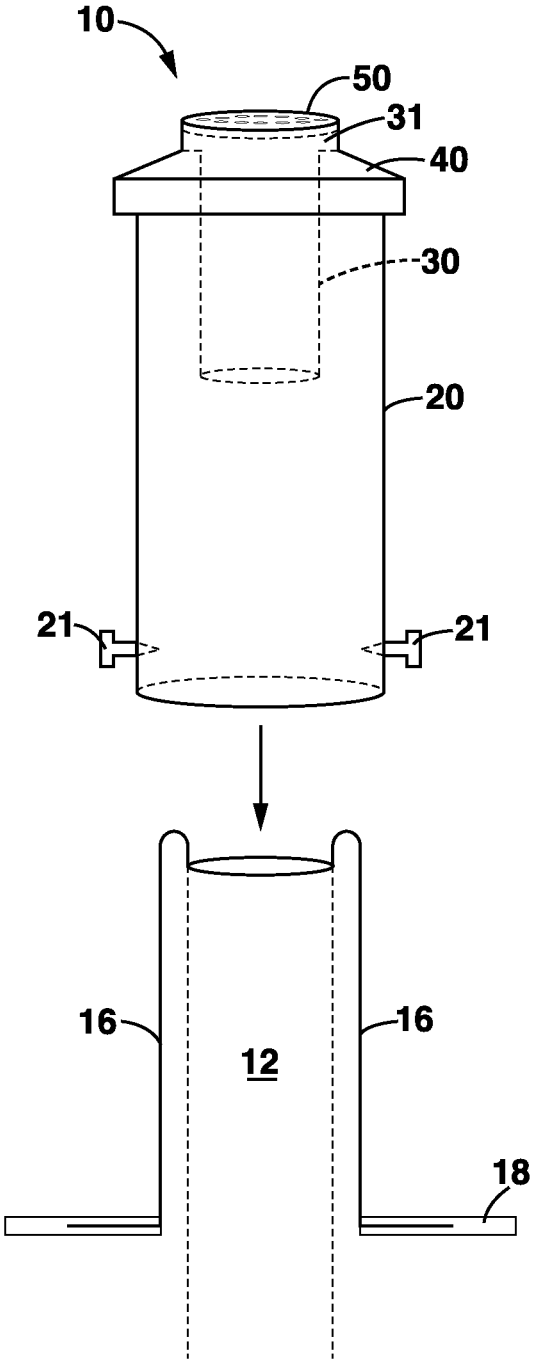
FIG. 2 is a perspective view of a vent guard in accordance with one embodiment of the present invention.

FIGS. 1 and 2 illustrate one embodiment of a vent sealing device that is useful for understanding the embodiments disclosed herein. To this end, vent sealing device 10 can include an outer tube 20, an inner tube 30, a collar 31, a cap 40, and a screen 50.

The outer tube 20 acts to provide a barrier against exterior elements and can include an elongated hollow tubular section having an inner diameter that is greater than both a conventional plumbing vent 12 and conventional flashing 16. (See FIG. 2) Although illustrated as having a bottom portion that is perpendicular to the top, the lower end of the outer tube 20 may be disposed at one or more angles to match the existing surface profile of the roof 18. (See FIG. 3)

In one preferred embodiment, outer tube 20 can be constructed from a durable and waterproof material such as polyvinyl chloride pipe (PVC), or acrylonitrile butadiene styrene (ABS) plastic, for example. However, one of skill in the art will recognize that many other materials having similar characteristics can be utilized without diverting from the scope and spirit of the invention.

Outer tube 20 can also include one or more fasteners 21 for securing the vent guard 10 to the flashing/plumbing vent for which it is to cover. As described herein, fasteners can include virtually any type of known hardware capable of securing two objects together. Such hardware can include nails, bolts, screws, punch pins and rivets, among many others.

The inner tube 30 can act to direct rain water into the vent 12 without exposing the existing flashing (which may be damaged and/or leaking) to the elements. As such, the inner tube 30 can be positioned inside the outer tube 20 and can comprise an elongated hollow tubular member. In one embodiment, the bottom portion of the inner tube 30 can include an outer diameter that is small enough to be inserted into the plumbing vent 12. To this end, when the inner tube 30 is positioned within the plumbing vent 12, the inner tube can act to provide lateral stability to the vent guard 10, which is useful when being exposed to adverse wind and weather conditions. Moreover, in this capacity, any rain water entering the device 10 can be directed into the vent pipe 12.

In one preferred embodiment, inner tube 30 can be approximately one half the length of the outer tube 20 and can be constructed of a PVC pipe or other similar material having good tensile strength. However, other lengths and materials are also contemplated. For example, in one embodiment the inner tube 30 can have a length that is greater than the outer tube 20 such that the inner tube extends beyond the bottom of the outer tube (See FIG. 4). Such an embodiment can provide additional stability to the vent guard 10 when secured to an existing plumbing vent. Alternatively, the inner tube 30 can include a length that does not penetrate into the vent pipe 12 but rather ends just above the top portion of the vent pipe. In this instance, the inner tube 30 will not act to provide lateral support to the device 10, but will still act to direct any and all rain water directly into the vent pipe 12 without exposing the existing flashing to the elements.

Although the inner tube 30 is illustrated above as having a uniform diameter, other embodiments are also contemplated. For example, the diameter of the upper portion of the inner tube 30 can increase steadily, or may abruptly shift to a new diameter, in both cases producing the effect of the collar 31 as illustrated in FIGS. 1 and 2. Alternatively, collar 31 can include a separate element permanently affixed to the top of the inner tube 30 having a shape approximating that of the upper portion of the cap 40 described below.

The cap 40, according to one embodiment can include an upper section 41, and a lower section 43 connected via a middle graduated or frustum-like hollow section 42. In one preferred embodiment, the three sections 41, 42 and 43 combine to form the cap 40 in one continuous piece while providing a hollow interior.

To this end, the inner diameter of the lower cylindrical section 43 can correspond to the outer diameter of the outer tube 20 such that the outer tube can be securely affixed to the cap 40. Likewise, the inner diameter of the upper cylindrical section 41 can correspond to the outer diameter of the collar 31 such that the collar can be securely affixed to the inside top portion of the cap 40.

The upper section of the cap 40 can further include an opening 41*a*. This opening can extend across the full diameter of the upper section of the cap or a portion thereof. In either case, opening 41*a* can be aligned with the top of the collar 40 and the collar 31 thus allowing air and water to flow unobstructed through the opening 41 & the collar 31 and into the inner tube 30. In this regard, the opening 41*a* can act to expel air from the vent pipe to the environment, while simultaneously directing any rain water into the vent pipe 12 via the inner tube 30.

Although described above as including a graduated frustum-like section having an upper and lower surface, alternate embodiments can include a cap having a generally planar construction configured to secure the outer and inner tubes at the same height. Accordingly, the invention is not to be limited to embodiments in which one portion of the cap is higher than other portions.

In another embodiment, the vent guard 10 can further include a screen or filter 50 which can be permanently or removably affixed to the upper section of the cap 41, in order to extend across the opening 41*a*. In one embodiment, the screen 50 can include a flat sheet of ABS plastic glued to the top of the opening 41*a*, having a plurality of small openings suitable for allowing air and water to flow into the opening 41*a* while restricting unwanted objects such as leaves, rodents and insects. Of course any suitable filter and/or conventional screen device or attachment material such as adhesive tape, hook and latch material (i.e. Velcro®) or the like capable of performing the above identified functions can also be utilized.

Figure 3:
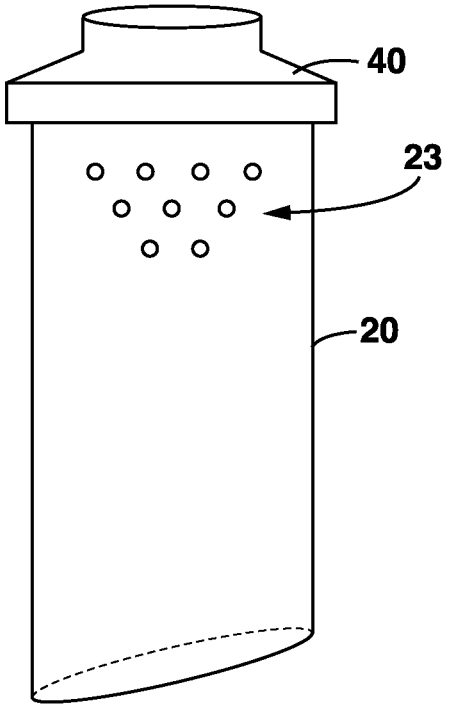
FIG. 3 is a front view of an alternate embodiment of the present invention.

FIG. 3 illustrates an alternative embodiment of a vent guard 10 that further includes one or more breathing/ventilation holes 23 positioned along the top of the outer tube 20. Holes 23 can be used to allow additional venting to the device when needed or desired.

Figure 4:
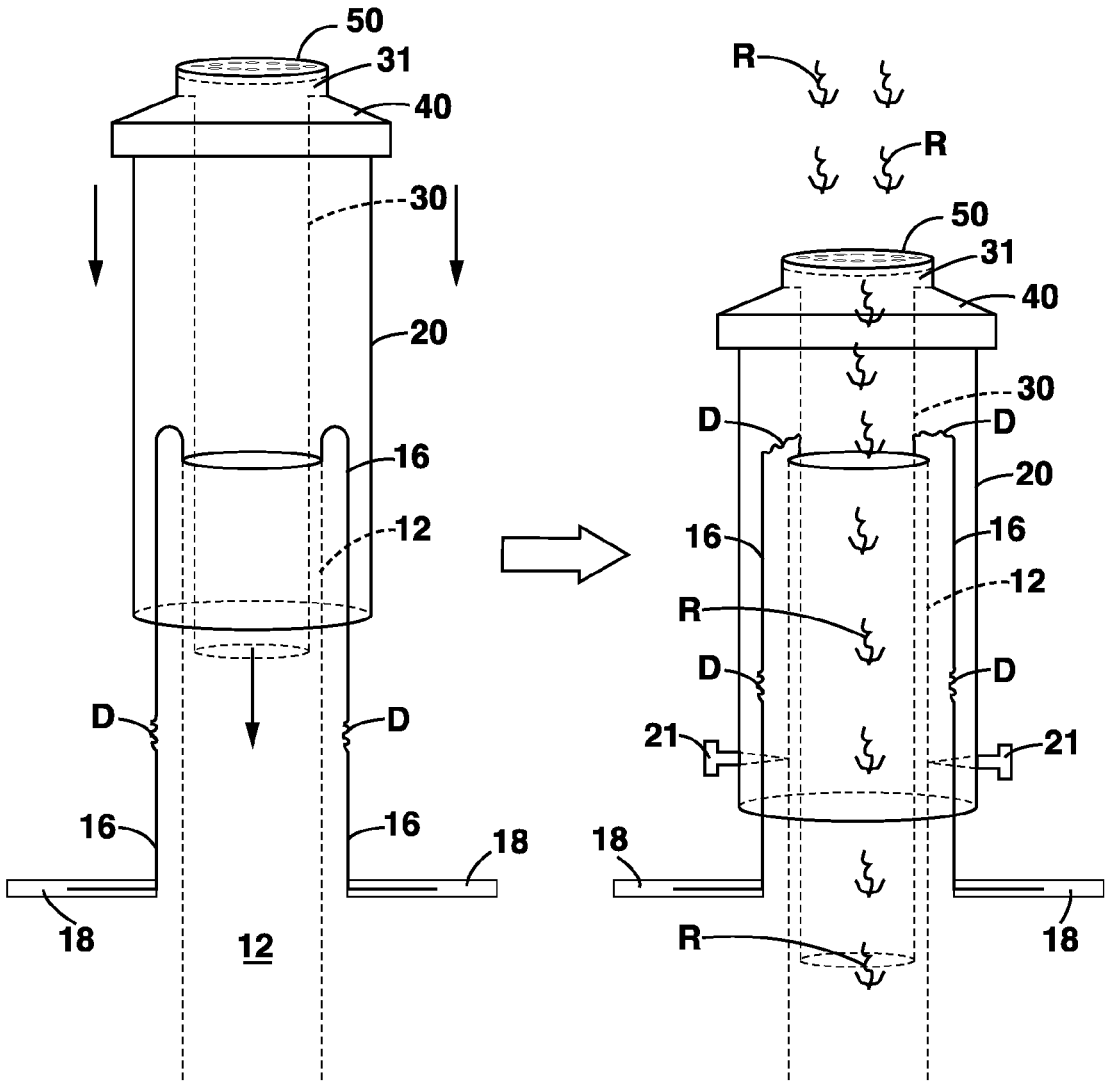
FIG. 4 is a side by side illustration of a vent guard in use according to one embodiment of the present invention.

FIG. 4 illustrates one embodiment of the vent guard 10, described above, in operation. As shown, vent guard 10 can be placed over an existing vent pipe 12 and flashing 16 by inserting the bottom end of the outer tube 20 down along the outside of the flashing 16 until the bottom of the outer tube 20 makes contact with the roof 18. In this regard, the inner tube 30 will be positioned either directly above the vent pipe 12 or can extend into the vent pipe 12 depending on the length of the inner tube 30 and the length of the vent pipe 12 protruding through the roof. In either instance, once the bottom of the outer tube 20 makes contact with the roof, the device 10 can be secured to the flashing and vent pipe 12 via the fasteners 21.

When so installed, the vent guard 10 can act to cover any damaged portions D in the existing flashing and prevent animals from chewing on or otherwise further damaging the flashing 16. Moreover, as described above, the vent guard will direct any rain water R directly into the vent pipe 12 without exposing the damaged flashing to the elements, and will also prevent debris and other foreign objects from gaining entry into the building via the screen 50. To this end, the inventive features disclosed herein can be utilized on existing roof structures without the need to remove conventional flashing which may or may not be damaged.

Figure 5:
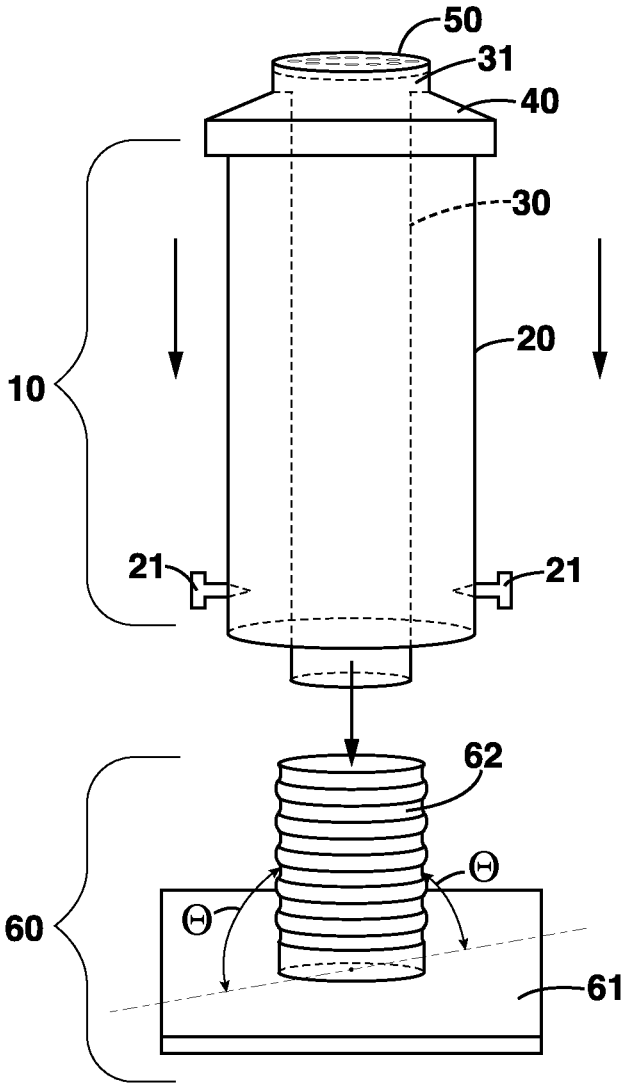
FIG. 5 is a front view of a vent sealing system according to one embodiment of the present invention.
Figure 6:
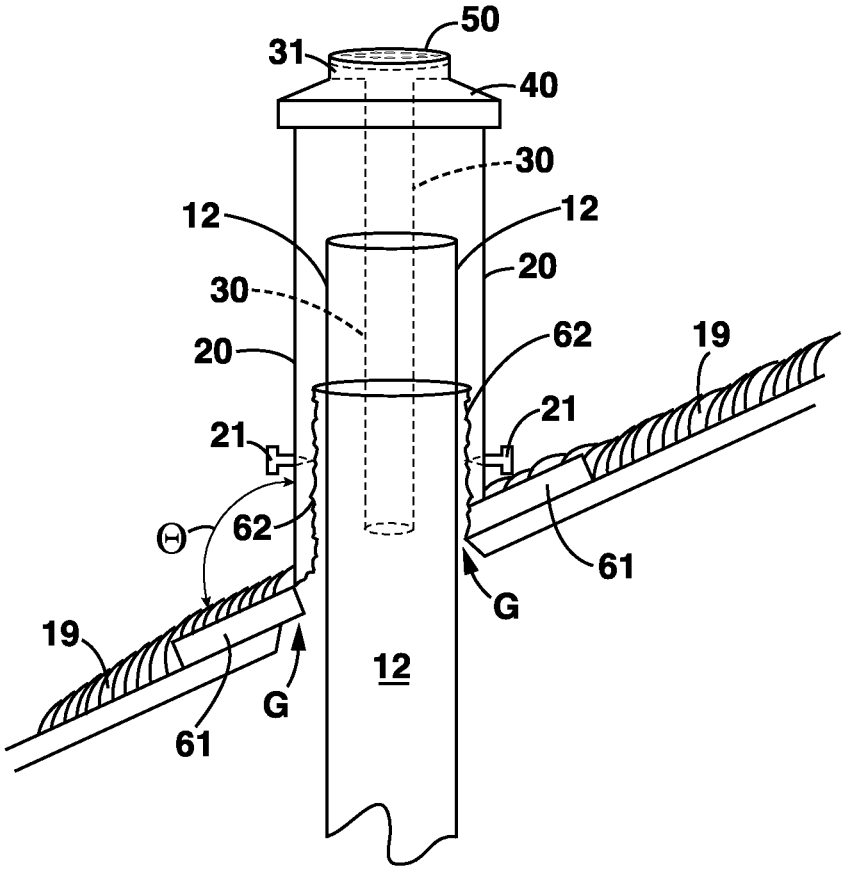
FIG. 6 is a front view of a vent sealing system in use according to one embodiment of the present invention.

FIGS. 5 and 6 illustrates one embodiment of a vent sealing system utilizing the vent guard 10 described above and a roof connection unit for allowing the vent guard 10 to be utilized on vent pipes 12 of new construction roofs 18 where no existing flashing has been installed.

The roof connection unit 60 can include a generally flat roof plate 61 configured to rest on top of a building roof 18, and a flexible (corrugated) tubular sleeve 62 configured to be placed over a portion of the vent pipe 12. In one embodiment, the flexible sleeve 62 can be located in the center of the roof plate 61 and can extend outward in a generally perpendicular manner. As described herein, the term "generally perpendicular" is purposefully selected to permit variation of the angles Θ between the roof surface 18 and the vent pipe 12.

As shown in FIG. 6, the system can be installed on a new construction roof (or a roof that is having new shingles installed) as an alternative to conventional flashing. To this end, the flexible sleeve 62 of the connection unit can be positioned over the vent pipe 12 and slid down until the roof plate 61 makes contact with the roof or until a desired position has been achieved. Owing to the flexibility of the sleeve, it is possible for the base plate 61 to be adjusted to rest on the roof surface at virtually any angle Θ.

Once in place, the vent guard can be installed by inserting the bottom end of the inner tube 30 into the vent pipe 12 and sliding the device down until the bottom end of the outer tube 20 makes contact with the base plate 61. In this regard, the outer tube 20 will act to encompass the flexible sleeve 62 (note the inner diameter of the outer tube 20 is greater than the outer diameter of the flexible sleeve 62, thus allowing the flexible sleeve 62 to be positioned within the outer tube 20).

Once positioned, the vent guard 10 can be secured to the connection unit 60 via the fasteners 21 or by any number of additional means for securing two items together. In this regard, the system can utilize known components ranging from a leaf spring (not illustrated) interposed between the sleeve 62 and the outer tube 20, or can include threads for allowing the outer tube 20 to be "screwed" onto the flexible sleeve. These are but a few of the numerous possibilities for securing these items together which are contemplated by the inventive concepts disclosed herein.

As shown, the roof plate 61 can be secured in place via a plurality of additional fasteners 21 (such as nails, for example) or can be held in place by the roofing shingles 19. In this regard, any gap G between the vent pipe 12 and the roof surface 18 will be covered by the connection unit 60 without the need for conventional flashing and the vent guard 10 will act to direct rain water into the vent pipe 12, while also protecting against adverse elements and other unwanted pests as described above.

Figure 7:
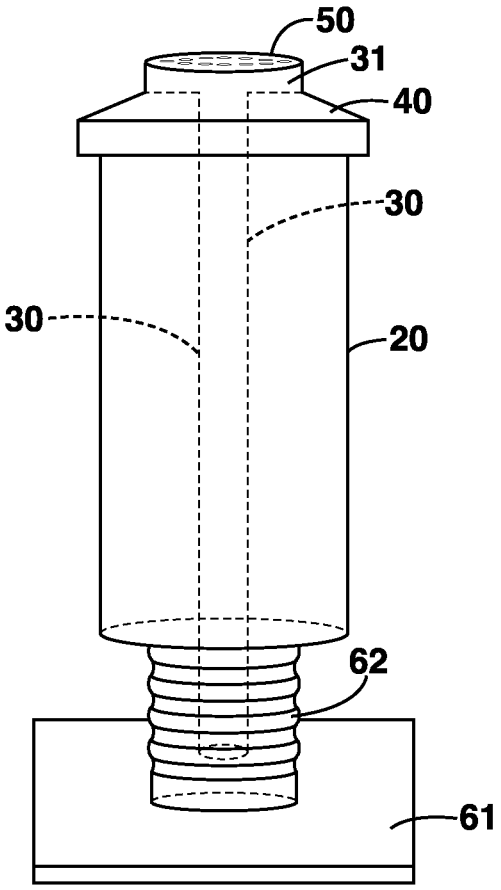
FIG. 7 is a front view of a vent sealing system according to another embodiment of the present invention.

FIG. 7 illustrates another alternate embodiment of a vent sealing system in which the outer tube 20 further includes a flexible tube 62 which is connected to a flat plate 61 as described above. In this regard, both the outer tube 20 and the flexible tube 62 can be fused into a single tubular member acting to perform the dual functions of both the outer tube 20 and the sleeve 62. To this end, resulting system can be installed in virtually the same manner as that described above in a single step.

As the above description explains, the vent sealing device and system can act to protect new and damaged flashing and vent pipes. To this end, in one embodiment, the device will fit snugly over the existing components. For example, in an instance where the vent pipe itself has a two inch opening, the vent sealing system can include the following dimensions: Inner pipe inside diameter is 1.8 inches and inner pipe outside diameter is 1.9 inches; the Base plate can be 2.5 inches; the outer shell inside diameter can be 2.9 inches and the outer shell outside diameter can be 3.1 inches. As would be known to one of skill in the art, the above dimensions are for illustration purposes only, as many other sizes are also contemplated.

As described above, each element of the vent guard 10 and/or the roof connection unit 60 can be secured together utilizing any number of known attachment means such as, for example, screws, glue, compression fittings, magnetic elements or other weather-resistant materials. Moreover, although the above embodiments have been described as including separate individual elements, the inventive concepts disclosed herein are not so limiting. To this end, one of skill in the art will recognize that one or more elements of the vent guard 10 including the outer tube 20, inner tube 30, collar 31, cap 40, and screen 50, and/or the roof attachment unit such as the base plate 61 and the sleeve 62 can be formed together as one continuous piece either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A vent sealing device for protecting a vent pipe and flashing extending from a building, said vent sealing device comprising:

a first hollow tubular member having a top end, a bottom end, and an inside diameter that is greater than an outside diameter of each of the vent pipe and the flashing;

a second hollow tubular member having a top end, a bottom end, and an outside diameter that is less than an inside diameter of each of the vent pipe and flashing;

a cap that functions to secure the second tubular member within the first tubular member, said cap including an upper section that is in communication with the top end of the second hollow tubular member, a lower section that is in communication with the top end of the first hollow tubular member, and a graduated generally frustum middle section that is disposed between the upper and lower sections, said cap further including an opening that is positioned along a central portion of the upper section, wherein said opening functions to direct rainwater into the second tubular member, and said middle section functions to prevent rainwater from entering the first tubular member; and a screen positioned along the opening, said screen being configured to prevent debris from entering the second tubular member, wherein the first hollow tubular member functions to cover an exposed portion of both the vent pipe and the flashing, and the cap and second hollow tubular member further function to prevent rainwater from making contact with the flashing.

2. The vent sealing device of claim 1, further including a collar interposed between the cap and the second tubular member, said collar being configured to align the second tubular member along a center axis of both the first tubular member and the vent pipe.

3. The vent sealing device of claim 1, wherein the bottom end of the first tubular member includes an angle approximating a pitch angle of the roof.

4. The vent sealing device of claim 1, further comprising:

one or more securing units configured to connect the outer tubular member to at least one of the flashing and vent the pipe.

5. The vent sealing device of claim 1, wherein the second tubular member includes a length that is less than the first tubular member.

6. The vent sealing device of claim 1, wherein the second tubular member is configured to be inserted into each of the vent pipe and the flashing.

7. The vent sealing device of claim 1, wherein the second tubular member includes a length that is greater than the first tubular member.

8. The vent sealing device of claim 7, wherein the second tubular member is configured to be inserted into each of the vent pipe and the flashing to provide lateral stability thereto.

9. The vent sealing device of claim 1, wherein the first tubular member further includes a plurality of ventilation holes configured to increase an air flow to the ventilation pipe.

10. A vent sealing device for protecting a vent pipe extending from a building, said vent sealing device comprising:

a generally planar member having an opening positioned along a center portion thereof, said planar member being configured to be placed on a building roof, and said opening being configured to receive the vent pipe;

a flexible hollow sleeve configured to cover a portion of the vent pipe, said sleeve having a first end connected to the planar member;

a first hollow tubular member having a top end, a bottom end, and an inside diameter, said inside diameter being greater than an outside diameter of the vent pipe and the flexible sleeve;

one or more securing units for securing the bottom end of the first hollow tubular member to the flexible hollow sleeve;

a second hollow tubular member having a top end, a bottom end, and an outside diameter, that is less than an inside diameter of the vent pipe;

a cap that functions to secure the second tubular member within the first tubular member, said cap including an upper section that is in communication with the top end of the second hollow tubular member, a lower section that is in communication with the top end of the first hollow tubular member, and a graduated generally frustum middle section that is disposed between the upper and lower sections, said cap further including an opening that is positioned along a central portion of the upper section, wherein said opening functions to direct rainwater into the second tubular member, and said middle section functions to prevent rainwater from entering the first tubular member; and a screen positioned along the opening, said screen being configured to prevent debris from entering the second tubular member, wherein the flexible hollow sleeve and the first hollow tubular member function to cover an outside portion of the vent pipe, and the cap and second hollow tubular member further function to prevent rainwater from making contact with the outside portion of the vent pipe.

11. The vent sealing device of claim 10, further including a collar interposed between the cap and the second tubular member, said collar being configured to align the second tubular member along a center axis of both the first tubular member and the vent pipe.

12. The vent sealing device of claim 10, wherein the second tubular member includes a length that is greater than the first tubular member.

13. The vent sealing device of claim 12, wherein the second tubular member is configured to be inserted into the vent pipe.

14. The vent sealing device of claim 10, wherein the first tubular member further includes a plurality of ventilation holes configured to increase an air flow to the ventilation pipe.

15. A vent sealing system for protecting a vent pipe extending from a building, said vent sealing system comprising:

a vent sealing device that includes:

a first hollow tubular member having a top end, a bottom end, and an inside diameter that is greater than an outside diameter of the vent pipe, wherein the first hollow tubular member is configured to cover a portion of the vent pipe, a second hollow tubular member having a top end, a bottom end, and an outside diameter that is less than an inside diameter of the vent pipe, a cap that functions to secure the second tubular member within the first tubular member, said cap including an upper section that is in communication with the top end of the second hollow tubular member, a lower section that is in communication with the top end of the first hollow tubular member, and a graduated generally frustum middle section that is disposed between the upper and lower sections, said cap further including an opening that is positioned along a central portion of the upper section, wherein said opening functions to direct rainwater into the second tubular member, and said middle section functions to prevent rainwater from entering the first tubular member, and a screen positioned along the opening, said screen being configured to prevent debris from entering the second tubular member;

a roof connection unit that includes:

a generally planar member having an opening positioned along a center portion thereof, said planar member being configured to be placed on a building roof, and said opening being configured to receive the vent pipe, and a flexible hollow sleeve configured to cover a portion of the vent pipe, said sleeve having a first end connected to the planar member, and a second end configured to mate with the first tubular member; and one or more securing units configured to connect the vent sealing device to the roof connection unit in a removable manner.

16. The device of claim 1, wherein each of the first hollow tubular member, the second hollow tubular member, the cap and the screen are constructed from a unitary piece of waterproof material.

* * * * *